United States Patent [19]

Georgilas

[11] Patent Number: 5,067,712

[45] Date of Patent: Nov. 26, 1991

[54] MULTIPLE-PULL SLOT MACHINE

[75] Inventor: Michael Georgilas, Reno, Nev.

[73] Assignee: Hilton Nevada Corporation, Las Vegas, Nev.

[21] Appl. No.: 305,950

[22] Filed: Feb. 2, 1989

[51] Int. Cl.[5] ..... G07F 17/34

[52] U.S. Cl. ..... 273/143 R; 273/138 A

[58] Field of Search ..... 273/143 R, 139 A, 139 R, 273/138 A, 85 CP; 364/410–412

[56] References Cited

U.S. PATENT DOCUMENTS

| | | | |
|---|---|---|---|
| 4,095,795 | 6/1978 | Saxton et al. | 273/143 R |
| 4,241,920 | 12/1980 | Hooker | 273/143 R |
| 4,508,345 | 4/1985 | Okada | 373/143 R |
| 4,700,948 | 10/1987 | Okada | 273/143 R |

FOREIGN PATENT DOCUMENTS

| | | | |
|---|---|---|---|
| 3220395 | 12/1983 | Fed. Rep. of Germany | 273/143 R |
| 3601631 | 7/1987 | Fed. Rep. of Germany | 273/143 R |
| 1591623 | 6/1981 | United Kingdom | 273/143 R |
| 2068619 | 8/1981 | United Kingdom | 273/143 R |
| 2092797 | 8/1982 | United Kingdom | 273/143 R |
| 2097570 | 11/1982 | United Kingdom | 273/143 R |
| 2153572 | 8/1985 | United Kingdom | 273/143 R |
| 2180087 | 3/1987 | United Kingdom | 273/143 R |

*Primary Examiner*—Edward M. Coven
*Assistant Examiner*—Jessica J. Harrison
*Attorney, Agent, or Firm*—Lyon & Lyon

[57] ABSTRACT

An amusement apparatus of the type typically referred to as a slot machine, wherein a complete game of said apparatus consists of at least two complete playing cycles if a prize winning result does not occur at the end of the first cycle, whereby each cycle involves separate pulls of the handle of said apparatus. If at the end of a first playing cycle, the player obtains a winning combination of symbols, the game is terminated and the player is awarded a prize; if at the end of a first playing cycle the player obtains a non-winning combination of symbols, at least a second separate cycle can be played, the conclusion of which terminates the game.

9 Claims, 3 Drawing Sheets

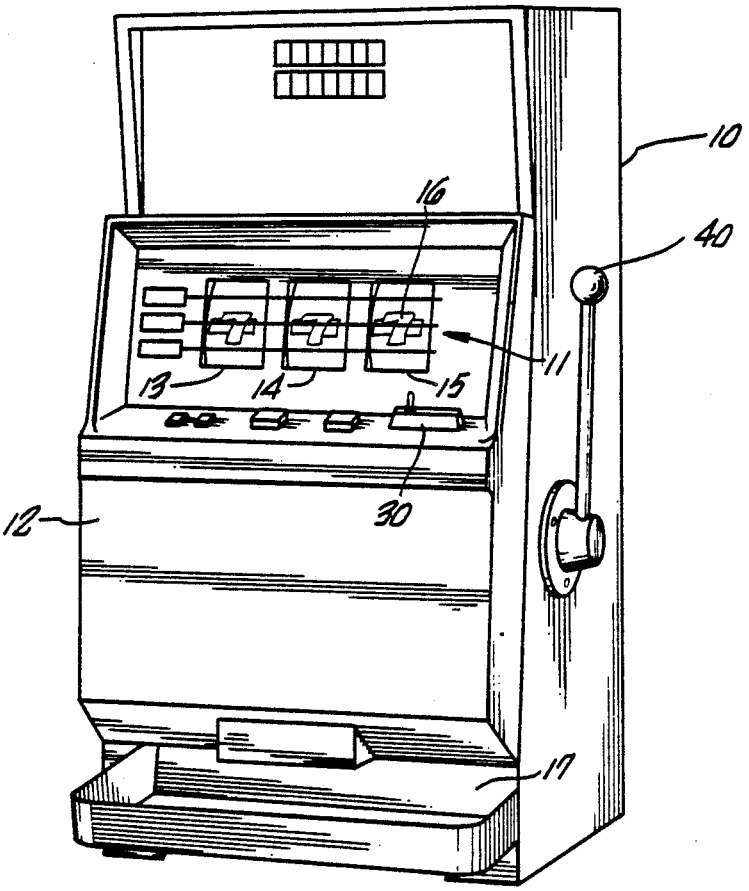
FIG. 1.
FIG. 3.
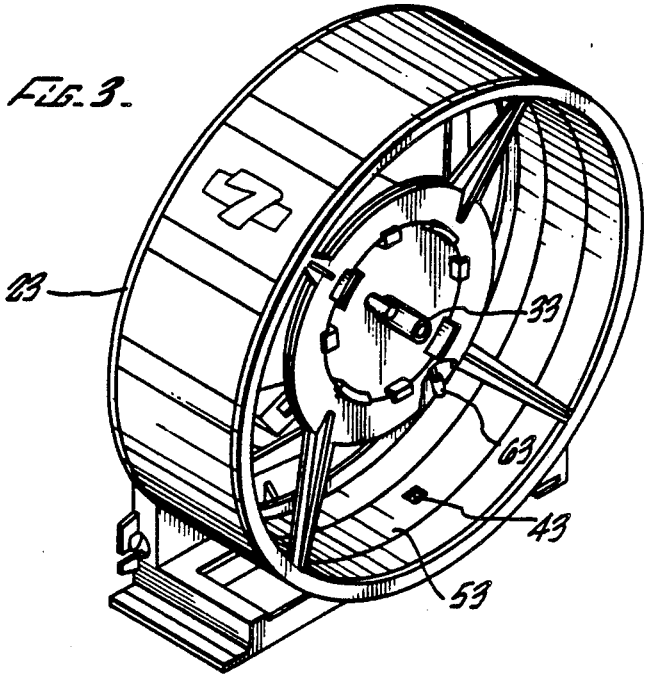

MULTIPLE-PULL SLOT MACHINE

BACKGROUND OF THE INVENTION

The present invention relates to an amusement apparatus of the type typically referred to as a slot machine.

DESCRIPTION OF RELATED ART

Publications and other materials used to illuminate the Background, Summary and Detailed Description of the Invention are incorporated herein by reference.

Generally, slot machines comprise a plurality of coaxially mounted rotatable drums, each bearing on its periphery a variety of symbols. Combinations of such symbols are displayed in a horizontal row within a viewing area. Different combinations of symbols have different predetermined pay-out values. Typically, a player deposits a token, playing disc or coin into the a slot area of the machine which allows the player to either activate a lever or depress a stationary button which allow the drums to be rotated. At the end of a normal playing cycle, the drums are arrested by suitable electrical or mechanical means, with each drum displaying a symbol in the viewing area. Together the symbols form combinations in a horizonal row with certain of the combinations being considered winning combinations while certain other combinations are considered losing combinations. Upon the occurrence of a winning combination, the player is entitled to a token, playing disc, coin or other similar prize. Upon the occurrence of a losing combination, however, the player must insert another token, playing disc or coin in order to initiate another game.

Previous slot machine devices have attempted to increase the amusement value of the game by altering the events that transpire upon a losing combination. For example, in U.S. Pat. No. 4,241,920, if at the end of a normal cycle a losing combination is displayed, the player has at least one chance of winning a prize by reason of the automatic movement of at least one of the drums by a predetermined fractional turn to cause to be displayed a new or different combination of symbols, thereby affording the player an increased opportunity to win a prize. In U.S. Pat. No. 4,508,345, a player-friendly bonus game is disclosed, whereby upon the occurrence of a specific or predetermined symbol, the machine allows for a bonus game immediately following the original game. Whereas in the original game the motors driving the reels do so at a fast speed, in the bonus game the reels are driven at a slower speed such that the player can stop individual reels during the bonus game. Reference is also made to Great Britain Patent No. 2,153,572.

While such devices attempt to increase both player interest and the amusement value of the game by providing a "bonus" game, these factors would substantially increase if a playing game consisted of at least two complete cycles whereby at the end of a first cycle when no winning combination of symbols is displayed, the player is permitted to play at least one additional cycle by reactivating the player lever or by depressing anew the starting button. The device is preferably conditioned to alter the odds of a winning combination occurring during the second cycle such that the possibility of achieving a winning combination during this cycle would be slightly lower or slightly higher then the probability of winning during the first cycle, but the odds could remain the same.

Reference is further made to U.S. Pat. No. 4,095,795 and the IGT S-Plus Stepper Slot Machine, for examples of conventional slot machines whereby an internal computer determines the final positions of the reels and thus, the symbols which determine whether or not the player has won that particular game.

SUMMARY OF THE INVENTION

In accordance with an amusement apparatus of the foregoing character, the slot-machine of the present invention enhances the winning potential of a player, while increasing player interest in the device, by allowing for at least two playing cycles during a game and by providing a means for detecting at the end of a first cycle a losing combination of symbols and thereafter allowing for an opportunity to continue the game for at least a second playing cycle. During the second cycle, the mathematical probability of a player achieving a winning combination of symbols can be slightly lower, higher or remain the same as compared to the probability of achieving a winning combination of symbols during the first cycle. This dramatically increases the amusement value of the device. Additionally, the opportunity to literally play at least two cycles during each game enhances not only the amusement value of the device, but because only a losing combination of symbols allows for the subsequent playing cycle, the opportunity for a second chance at winning satisfies the objective of increased players interest in the device.

The following drawings are set forth merely for illustrative purposes and are not to be construed as limiting or constricting the present invention in any manner.

BRIEF DESCRIPTION OF THE DRAWINGS

FIG. 1 is a perspective view of a slot machine device according to the present invention;

FIG. 3 is a perspective view of a reel according to the present invention;

DESCRIPTION OF THE PREFERRED EMBODIMENT

Figure 4:
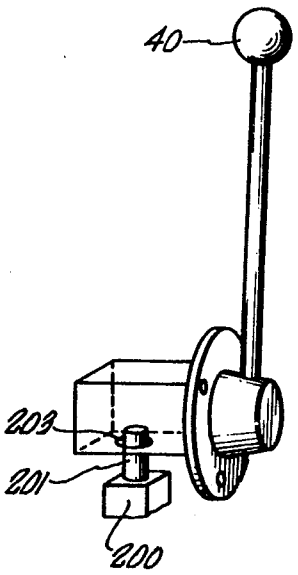
FIG. 4 is a perspective view of the handle of the slot machine according to the present invention.

The amusement apparatus embodying the present invention can be utilized in conjunction with existing slot machines such as the aforementioned IGT S-Plus. The device of FIG. 1 comprises a mechanism housed within a cabinet 10 provided with a viewing area 11 located on the upper-portion of a front panel 12 of the cabinet. Viewing area 11 is subdivided into at least (and preferably) three elongated viewing areas 13, 14 and 15. Three vertically aligned symbols are visible in the viewing area. Monetary or non-monetary playing discs are deposited by the player in slot 30. After such discs are deposited therein, handle 40 is pulled to initiate the game. At the occurrence of a winning combination of symbols, a prize is deposited in basket 17.

Figure 2:
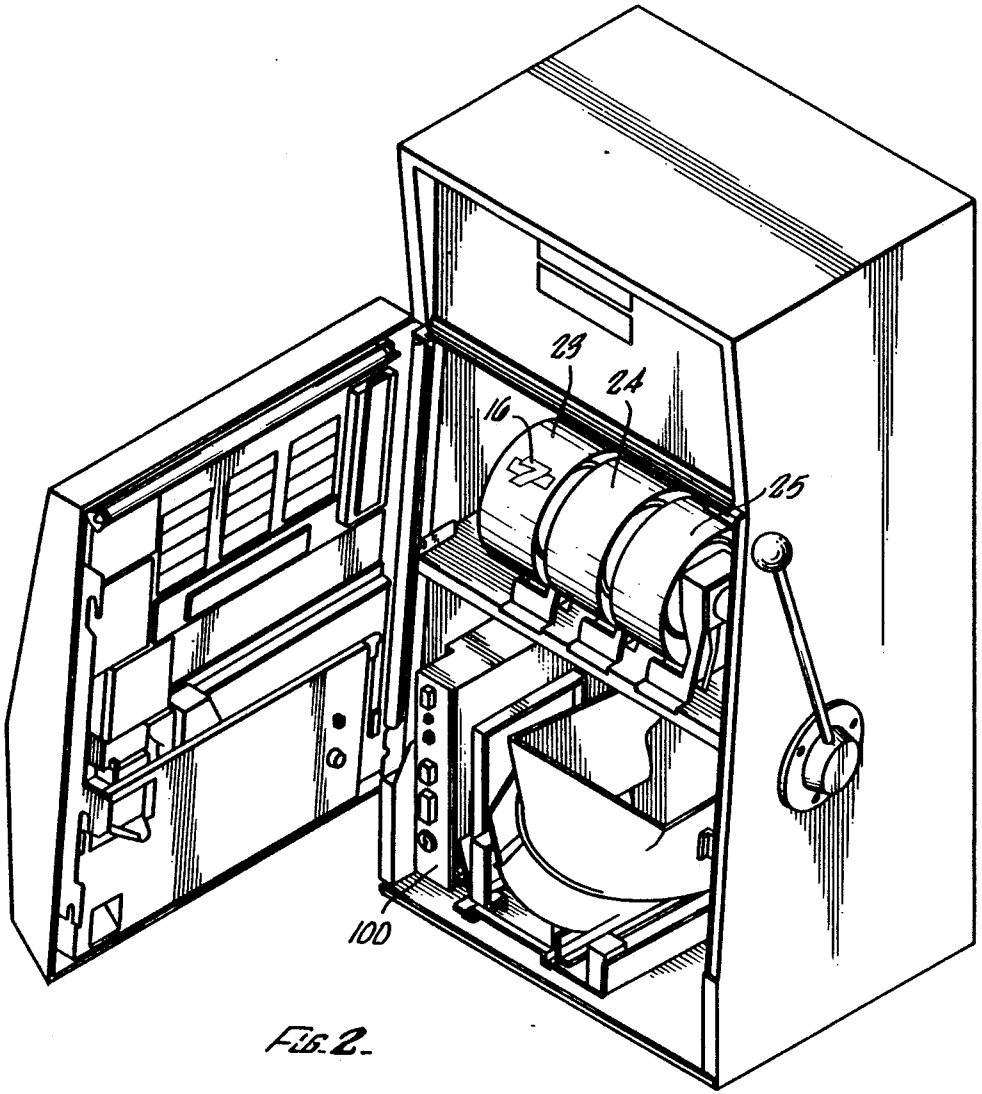
FIG. 2 is a perspective view of the internal portion of the slot machine according to the present invention.

As illustrated in FIG. 2, the mechanism contained within the cabinet includes three stepper reels 23, 24 and 25, co-axially mounted in a side by side relationship. Each reel includes a peripheral viewing strip on which are displayed a plurality of symbols 16, e.g., a bar-seven. The reels 23, 24 and 25 are disposed in registration with respective viewing areas 13, 14 and 15.

Each stepper reel is provided with its own electric motor. For example, reel 23 of FIG. 3 is rotably mounted on a shaft 33 operatively connected to an electric motor (not shown). To arrest rotation of the reel, a solenoid actuated indexing stop (not shown) is disposed in proximate relation to reel 23, with a conductor lead interconnecting the solenoid stop with the micro-computer 100 of FIG. 2. Computer 100 provides indexing stop signals to energize the solenoid stop via signals generated by the particular program residing in the computer memory. As is readily appreciated by those skilled in the art, an optical wheel start position sensor 43 located on optical track 53 of reel 23 is arranged to detect a starting indicia on each reel. This is accomplished by transmission of light from optical light source 63. The number of rotations of said reel can be sensed and monitored by the computer via said position sensor by means of a pulse generated from said optical track (when activated by light transmitted from optical light source 63) via a conductor lead to computer 100.

Computer 100 is a computer means of known type, comprising a random access memory ("RAM"), a central processing unit ("CPU"), a read-only memory ("ROM") into which is stored the control instructions, and other conventional auxiliary devices including, e.g., registers, computer clock, input and output ports, etc. Computer 100 performs functions in accordance with a program entered into said computer by conventional methods. In response to various events as they occur, out-put pulses (such as those described above relative to the solenoid actuated indexing stop) and in-put pulses are produced and received by said computer for energizing or actuating selected devices which operate other devices, or for receiving information regarding the occurrence of some event. The flow chart of FIG. 5 illustrates the specific commands as they relate to the present invention.

Figure 5:
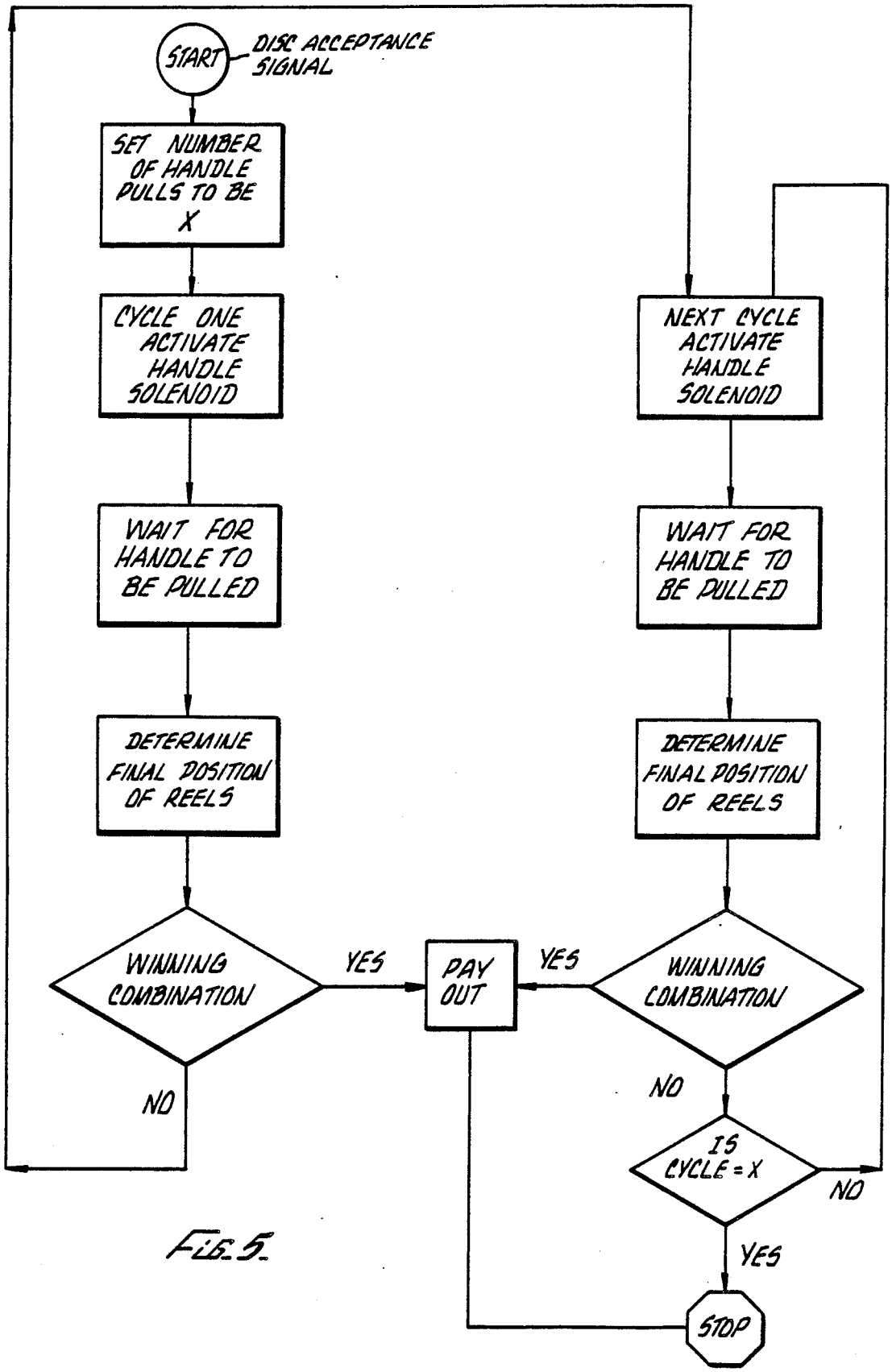
FIG. 5 is a flow diagram of the commands generated by the computer in accordance with the present invention.

As illustrated in FIG. 5, once a playing disc is inserted into receptacle 30 on the device, the computer program is initiated via a lead from the disc acceptor system to computer 100. Such acceptor systems ar well known in the art and operate to receive or reject a disc based upon the size and weight of an inserted disc tested by springs and calipers, with magnetic devices used to test the quality of the disc. The first pulse generated by computer 100 is to provide for activation of the player handle or lever. A handle-lock mechanism 200 of FIG. 4, typically a solenoid, has a pin 201 which engages a notch or aperture 203 in handle 40. During cycle one, when a disc acceptance signal has been generated by computer 100, pin 201 is released and handle 40 can be pulled, which in turn produces a handle-pulled signal, the occurrence of which signal is applied to computer 100 which in turn generates a reel start signal.

After the handle is pulled, the computer determines the final position of the reels based upon preprogrammed probabilities stored within the computer. As such, the computer determines the specific position that the reel will stop, and thus the specific symbol-combinations that are visible to the player. If the combination is a winning combination, the player is rewarded with a prize and the solenoid that releases the handle is not activated. If, after the first cycle, a losing combination of symbols is presented, the computer generates a pulse to activate solenoid 200 such that the handle can be pulled at least one more time for at least a second playing cycle.

The second playing cycle, is, of course, played in the same way as the first, the sole exception being that the computer is programmed to utilize a second set of probability values for winning combinations for the second cycle. Thus, after the handle is pulled, the computer still generates pulses to stop each reel individually, but the probability of obtaining a winning combination during the second cycle relative to the first, is increased, decreased or identical.

The scoring signal originates in computer 100 when a sequence of reel stop signals at the computer-selected symbol stop positions (corresponding to a particular winning combination) are matched against pre-programmed (stored) scoring symbol signals derived from the ROM of computer 100. Upon the occurrence of a losing combination (i.e. non-correspondence to a particular winning combination), pin 201 is again released, allowing for at least one additional pull of handle 40. During the second cycle, however, the handle pull is not predicated upon disc acceptance. Rather, the second handle pull is directly controlled by the non-winning combination event of the first playing cycle, such that when all three reels have completely stopped rotating, the computer is programmed to begin the playing cycle anew by releasing the handle lock mechanism if the three reels display a non-winning combination. When handle 40 is pulled for the second time, a second scoring signal originates in computer 100 when a second sequence of reel stop signals at the computer-selected symbol stop positions (corresponding to a particular winning combination) are matched against a second set of pre-programmed scoring symbol signals derived from the ROM of computer 100.

Table I sets forth an example of the change in probabilities that reflects a decreased probability of winning during the second playing cycle:

TABLE I

| SYMBOLS | | | NUMBER OF OCCURRENCES | | | POSSIBILITY OF OCCURRENCE | PROBABILITY OF OCCURRENCE | PAY | VALUE |
|---|---|---|---|---|---|---|---|---|---|
| | | | | | | CYCLE ONE | | | |
| S | S | S | 1 | 1 | 1 | 1 | 0.00% | 1000 | 1000 |
| S | — | — | 1 | 31 | 31 | 961 | 2.93% | 1 | 961 |
| — | S | — | 31 | 1 | 31 | 961 | 2.93% | 1 | 961 |
| — | — | S | 31 | 31 | 1 | 961 | 2.93% | 1 | 961 |
| S | S | — | 1 | 1 | 1 | 31 | 0.09% | 5 | 155 |
| S | — | S | 1 | 31 | 1 | 31 | 0.09% | 5 | 155 |
| — | S | S | 31 | 1 | 1 | 31 | 0.09% | 5 | 155 |
| TB | TB | TB | 7 | 2 | 1 | 14 | 0.04% | 100 | 1400 |
| DB | DB | DB | 2 | 2 | 6 | 24 | 0.07% | 50 | 1200 |
| SB | SB | SB | 6 | 15 | 2 | 180 | 0.55% | 10 | 1800 |
| BL | BL | BL | 16 | 12 | 22 | 4224 | 12.89% | 2 | 8448 |

TABLE I-continued

| SYMBOLS | | | NUMBER OF OCCURRENCES | | | POSSIBILITY OF OCCURRENCE | PROBABILITY OF OCCURRENCE | PAY | VALUE |
|---|---|---|---|---|---|---|---|---|---|
| 1 COIN | | | 32 | 32 | 32 | 7,419 | 38.86% | | 17,196 |
| | | | | | | | TOTAL COMBINATIONS | | 32,768 |
| | | | | | | | HIT FREQUENCY | | 22.641% |
| | | | | | | | 1ST PULL PAY BACK | | 52.478% |
| | | | | | | CYCLE TWO | | | |
| S | S | S | 1 | 1 | 1 | 1 | 0.00% | 1000 | 1000 |
| S | — | — | 1 | 31 | 31 | 961 | 2.93% | 1 | 961 |
| — | S | — | 31 | 1 | 31 | 961 | 2.93% | 1 | 961 |
| — | — | S | 31 | 31 | 1 | 961 | 2.93% | 1 | 961 |
| S | S | — | 1 | 1 | 1 | 31 | 0.09% | 5 | 155 |
| S | — | S | 1 | 31 | 1 | 31 | 0.09% | 5 | 155 |
| — | S | S | 31 | 1 | 1 | 31 | 0.09% | 5 | 155 |
| TB | TB | TB | 7 | 1 | 1 | 7 | 0.02% | 100 | 700 |
| DB | DB | DB | 2 | 2 | 16 | 64 | 0.20% | 50 | 3200 |
| SB | SB | SB | 9 | 15 | 3 | 405 | 1.24% | 10 | 4050 |
| BL | BL | BL | 13 | 13 | 11 | 1859 | 5.67% | 2 | 3718 |
| | | | 32 | 32 | 32 | 5,312 | 54.27% | | 16,016 |
| | | | | | | | TOTAL COMBINATIONS | | 32,768 |
| | | | | | | | HIT FREQUENCY | | 16.211% |
| | | | | | | | 1ST PULL PAY BACK | | 48.877% |

Table II sets forth an example of the change in probabilities that reflects an increased probability of winning during the second playing cycle:

TABLE II

| SYMBOLS | | | NUMBER OF OCCURRENCES | | | POSSIBILITY OF OCCURRENCE | PROBABILITY OF OCCURRENCE | PAY | VALUE |
|---|---|---|---|---|---|---|---|---|---|
| | | | | | | CYCLE ONE | | | |
| S | S | S | 1 | 1 | 1 | 1 | 0.00% | 1000 | 1000 |
| S | — | — | 1 | 31 | 31 | 961 | 2.93% | 1 | 961 |
| — | S | — | 31 | 1 | 31 | 961 | 2.93% | 1 | 961 |
| — | — | S | 31 | 31 | 1 | 961 | 2.93% | 1 | 961 |
| S | S | — | 1 | 1 | 1 | 31 | 0.09% | 5 | 155 |
| S | — | S | 1 | 31 | 1 | 31 | 0.09% | 5 | 155 |
| — | S | S | 31 | 1 | 1 | 31 | 0.09% | 5 | 155 |
| TB | TB | TB | 7 | 2 | 1 | 14 | 0.04% | 100 | 1400 |
| DB | DB | DB | 2 | 2 | 6 | 24 | 0.07% | 50 | 1200 |
| SB | SB | SB | 6 | 15 | 2 | 180 | 0.55% | 10 | 1800 |
| BL | BL | BL | 16 | 12 | 22 | 4224 | 12.89% | 2 | 8448 |
| 1 COIN | | | 32 | 32 | 32 | 7,419 | 38.86% | | 17,196 |
| | | | | | | | TOTAL COMBINATIONS | | 32,768 |
| | | | | | | | HIT FREQUENCY | | 22.641% |
| | | | | | | | 1ST PULL PAY BACK | | 52.478% |
| | | | | | | CYCLE TWO | | | |
| S | S | S | 1 | 1 | 1 | 1 | 0.00% | 1000 | 1000 |
| S | — | — | 1 | 31 | 31 | 961 | 2.93% | 1 | 961 |
| — | S | — | 31 | 1 | 31 | 961 | 2.93% | 1 | 961 |
| — | — | S | 31 | 31 | 1 | 961 | 2.93% | 1 | 961 |
| S | S | — | 1 | 1 | 1 | 31 | 0.09% | 5 | 155 |
| S | — | S | 1 | 31 | 1 | 31 | 0.09% | 5 | 155 |
| — | S | S | 31 | 1 | 1 | 31 | 0.09% | 5 | 155 |
| TB | TB | TB | 7 | 1 | 1 | 7 | 0.02% | 100 | 700 |
| DB | DB | DB | 2 | 2 | 8 | 32 | 0.10% | 50 | 1600 |
| SB | SB | SB | 9 | 15 | 4 | 545 | 1.65% | 10 | 5400 |
| BL | BL | BL | 13 | 13 | 18 | 3042 | 9.28% | 2 | 6084 |
| | | | 32 | 32 | 32 | 6,598 | 43.70% | | 18,132 |
| | | | | | | | TOTAL COMBINATIONS | | 32,768 |
| | | | | | | | HIT FREQUENCY | | 20.135% |
| | | | | | | | 1ST PULL PAY BACK | | 55.334% |

If only two playing cycles in a complete game are desired (as is preferred), then at the end of the second cycle, and irrespective of whether the player has won or lost during this cycle, computer 100 generates a pulse which energizes the solenoid stop to activate the lock mechanism 200 which causes pin 201 to engaged aperture 203. Thus, in order to play another two-cycle game, another playing disc would be necessary to begin a new game.

While the invention has been described and illustrated with respect to specific embodiments, it is to be understood that modifications and equivalents thereof may be apparent to those skilled in the art and are intended to be within the scope of the invention.

I claim:

1. An amusement apparatus having a plurality of rotating reels, arranged in a side-by-side relationship, each bearing a plurality of symbols on the peripheral surface thereof, certain combinations of which have different values which may entitle a player to a prize, and including:

means for accepting a playing disc to initiate a game by rotation of said reels;

means for analyzing and calculating the probability of obtaining certain combinations of said symbols during a first playing cycle;

means for arresting rotation of said reels at the end of said first cycle to display a first combination of symbols;

means for discriminating between a winning combination of symbols and a losing combination of symbols and a losing combination of symbols at the end of said first cycle;

means for discontinuing said first cycle and awarding a prize to said player upon the occurrence of a winning combination of symbols;

means for allowing activation of said reels for at least one other cycle at the end of each of said first cycle upon the occurrence of a losing combination of symbols;

means for automatically analyzing, calculating and altering the probability of obtaining certain combinations of symbols during said other cycle, said automatic altering being relative to said probability of obtaining certain combinations in said first playing cycle;

means for arresting rotation of said reels at the end of said other cycle to display a different combination of symbols; and means for discontinuing said other cycle upon the occurrence of a losing combination of symbols or awarding a prize to said player upon the occurrence of a winning combination of symbols.

2. The amusement device of claim 1 wherein said means for automatically analyzing, calculating and altering combinations of said symbols during said other cycle decreases the probability of winning combinations of said symbols relative to the probability of obtaining winning combinations of said symbols during said first cycle.

3. The amusement device of claim 1 wherein said means for automatically analyzing, calculating and altering combinations of said symbols during said other cycle increases the probability of winning combinations of said symbols relative to the probability of obtaining winning combinations of said symbols during said first cycle.

4. The amusement device of claim 1 wherein said means for discriminating between a winning combination of symbols and a losing combination of symbols at the end of said first cycle and said other cycle is a computer.

5. The amusement device of claim 1 wherein the playing disc is a non-monetary token.

6. The amusement device of claim 1 wherein the playing disc is a monetary token.

7. An amusement apparatus for playing a game having a plurality of rotating reels, arranged in a side-by-side relationship, each bearing a plurality of symbols on the peripheral surface thereof, certain combinations of which have different values which may entitle a player to a prize, the apparatus including means for providing at least two playing cycles if a prize winning combination does not occur at the end of the first cycle, said cycles consisting of at least one complete cyclical rotation and arrest of said reels, wherein after the arrest of said reels the occurrent of a losing combination of symbols on said reels at the end of the first playing cycle initiates at least one additional playing cycle, and means for automatically altering the probability of obtaining a prize winning combination during said at least one additional playing cycle, relative to the probability of obtaining a prize winning combination during said first cycle.

8. The amusement apparatus of claim 7 whereby the occurrence of a winning combination of symbols on said reels at the end of said first cycle terminates said game.

9. An amusement apparatus having a plurality of rotating reels arranged in a side-by-side relationship, each bearing a plurality of symbols on the peripheral surface thereof, certain combinations of which have different values which may entitle a player to a prize, means for providing at least a first and a second playing cycle if a prize winning combination does not occur at the end of the first cycle, said cycles consisting of at least one complete cyclical rotation and arrest of said reels, and means for automatically altering the probability of obtaining a prize winning combination during the second playing cycle, relative to the probability of obtaining a prize winning combination in said first playing cycle.

* * * * *